US006663402B1

(12) United States Patent
Yu

(10) Patent No.: US 6,663,402 B1
(45) Date of Patent: Dec. 16, 2003

(54) ELECTRICAL CONNECTOR HAVING GROUNDING BRIDGE

(75) Inventor: Hung-Chi Yu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/339,532

(22) Filed: Jan. 8, 2003

(51) Int. Cl.[7] ..... H01R 4/66
(52) U.S. Cl. ..... 439/108; 439/609; 439/181
(58) Field of Search ..... 439/108, 609, 439/181, 607, 608, 660, 74, 92

(56) References Cited

U.S. PATENT DOCUMENTS 5,344,341 A * 9/1994 Yoshino ..... 439/607
5,356,300 A * 10/1994 Costello et al. ..... 439/101
5,478,259 A * 12/1995 Noschese ..... 439/607
5,993,257 A * 11/1999 Maruyama ..... 439/607
6,390,833 B1 5/2002 Chang

* cited by examiner

*Primary Examiner*—Tho D. Ta
*Assistant Examiner*—James R. Harvey
(74) *Attorney, Agent, or Firm*—Wei Te Chung

(57) ABSTRACT

An electrical connector (10) includes an insulative housing (11) having an elongated base wall (111) and a mating wall (112) projecting upwardly from the base wall and provided with a pair of guiding columns (1120, 1121) on opposite ends thereof, a plurality of terminals (12) received in the housing, a metallic shield (15) attached to the housing, and a pair of grounding bridges (14) each having a body portion (141) and a resilient arm (141) extending upwardly from the body portion. Each guiding column defines a slot (1128). A pair of notches (1112) are defined in an upper surface of opposite ends of the base wall. Each notch communicates with a lower portion of a corresponding slot. The body portions of the grounding bridges are retained in the notches and the resilient arms extend in the slots. The body portions of the grounding bridges electrically connect with the metallic shield.

2 Claims, 6 Drawing Sheets

ELECTRICAL CONNECTOR HAVING GROUNDING BRIDGE

CROSS-REFERENCES TO RELATED APPLICATIONS

This application is related to a copending application filed on Dec. 23, 2002 with an unknown serial number and entitled "ELECTRICAL CONNECTOR HAVING GROUNDING BRIDGE", which is invented by the same inventor and assigned to the same assignee as this application and which is hereby fully incorporated by reference.

BACKGROUND OF THE INVENTION

1. Field of the Invention

The present invention relates to an electrical connector and particularly to an electrical connector having grounding bridges.

2. Description of Related Art

Electrical connectors usually have guiding columns to be inserted into guiding apertures of mating connectors for guiding the electrical connectors to engage with the mating connectors and grounding bridges provided on the guiding columns for contacting with grounding members of the mating connector for Electro-Static Discharge (ESD).

U.S. Pat. No. 6,390,833 discloses in FIGS. 7 and 8 thereof a connector 10 comprises a pair of metallic grounding pads 17 each having a contacting portion 174 exposed from opposite ends of the housing 11 for electrically engaging with a shield 23 of a mating connector 20. The grounding pads 17 are inserted into cavities 128 of the housing 11 from a bottom face of the housing 11, and the grounding pads 17 are positioned in the cavities 128 by junctures 176 thereof upwardly abutting against blocks 125, 126 on opposite ends of the housing 11 and first feet 175 thereof pressing against an inner side of the shield 13 attached to an outer side of the housing 11. Sometimes, customers want electrical connectors with grounding pads thereof retained in other ways.

Hence, an electrical connector with improved grounding bridges is desired.

SUMMARY OF THE INVENTION

An object of the present invention is to provide an electrical connector having grounding bridges which can be reliably retained therein and which can assure an electrical connection thereof with a shield of a mating connector complementary to the electrical connector.

To achieve the above object, an electrical connector in accordance with the present invention comprises an insulative housing having an elongated base wall and a mating wall projecting upwardly from an upper surface of the base wall and provided with a pair of guiding columns on opposite ends thereof, a plurality of terminals received in the housing, a metallic shield attached to an outer side of the insulative housing, and a pair of grounding bridges each having a body portion and a resilient arm extending upwardly from the body portion. Each guiding column defines a slot. A pair of notches are defined in the upper surface of opposite ends of the base wall. Each notch communicates with a lower portion of a corresponding slot. The body portions of the grounding bridges are retained in the notches and the resilient arms extend in the slots. The body portions of the grounding bridges electrically connect with the metallic shield from the upper surface of the base wall.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
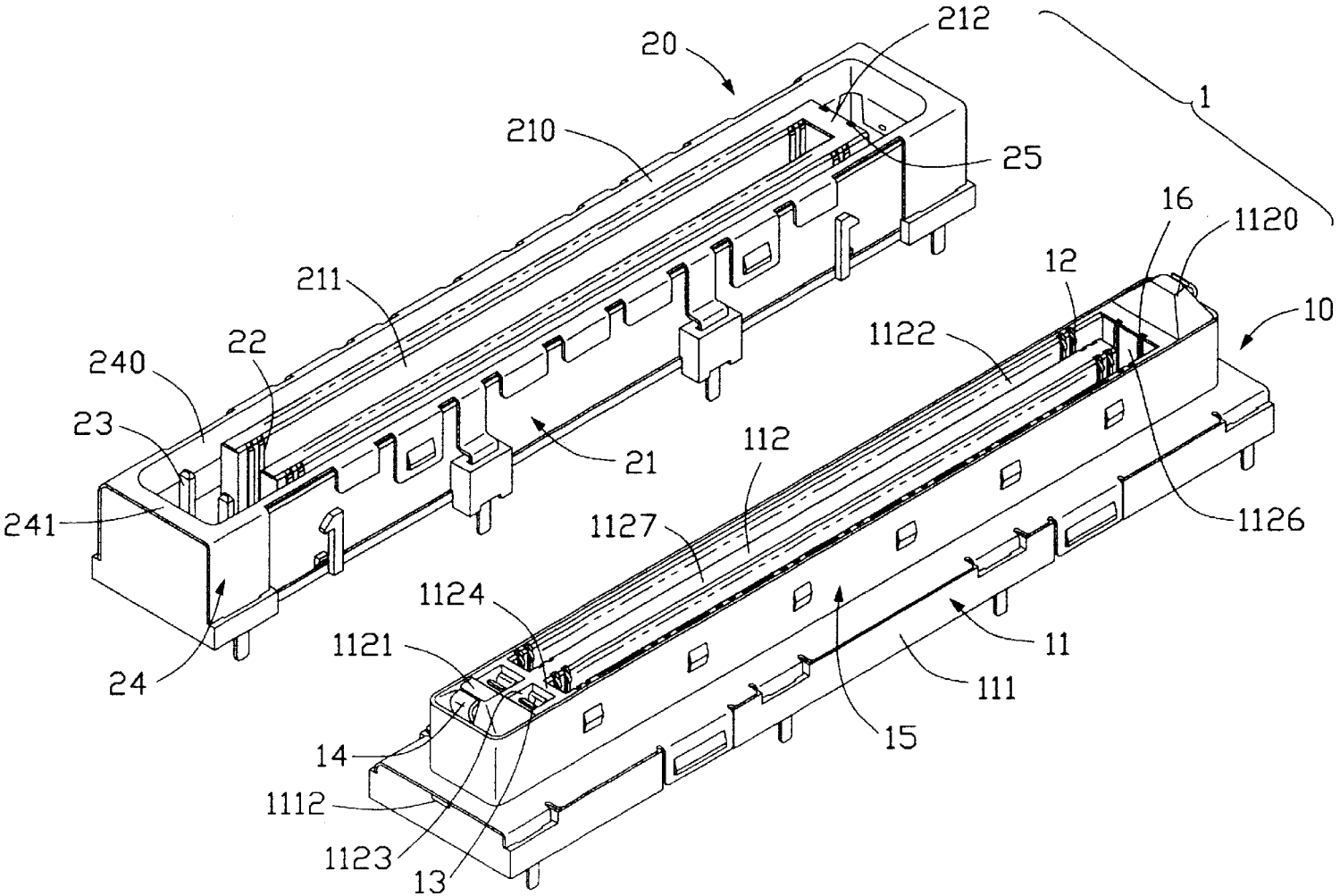
FIG. 1 is a perspective view of an electrical connector in accordance with the present invention and a mating connector complementary to the electrical connector.
Figure 2:
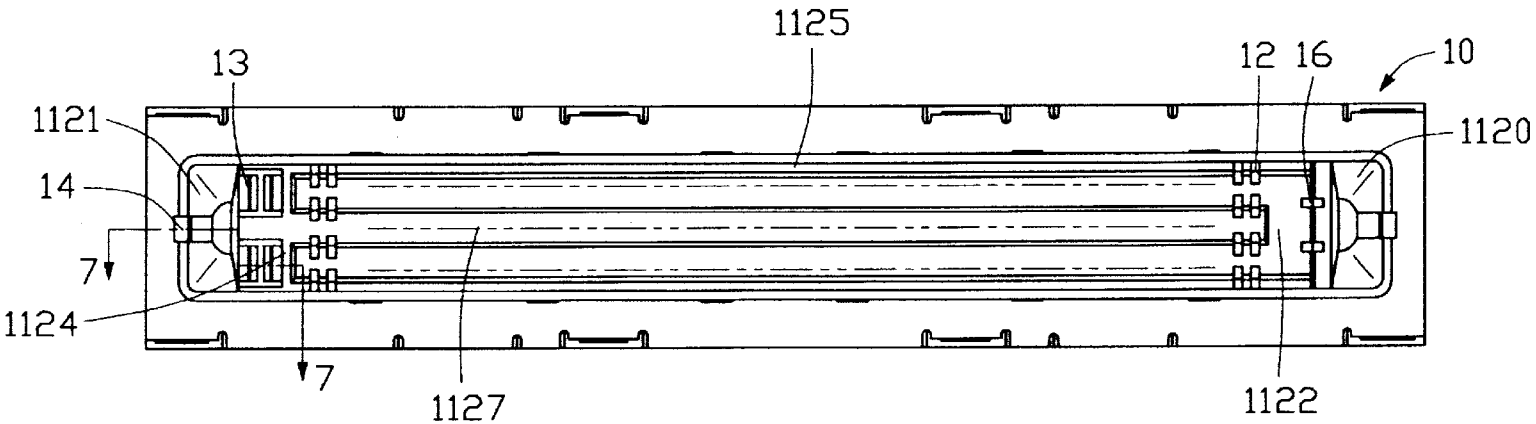
FIG. 2 is a top plan view of the electrical connector of FIG. 1.
Figure 3:
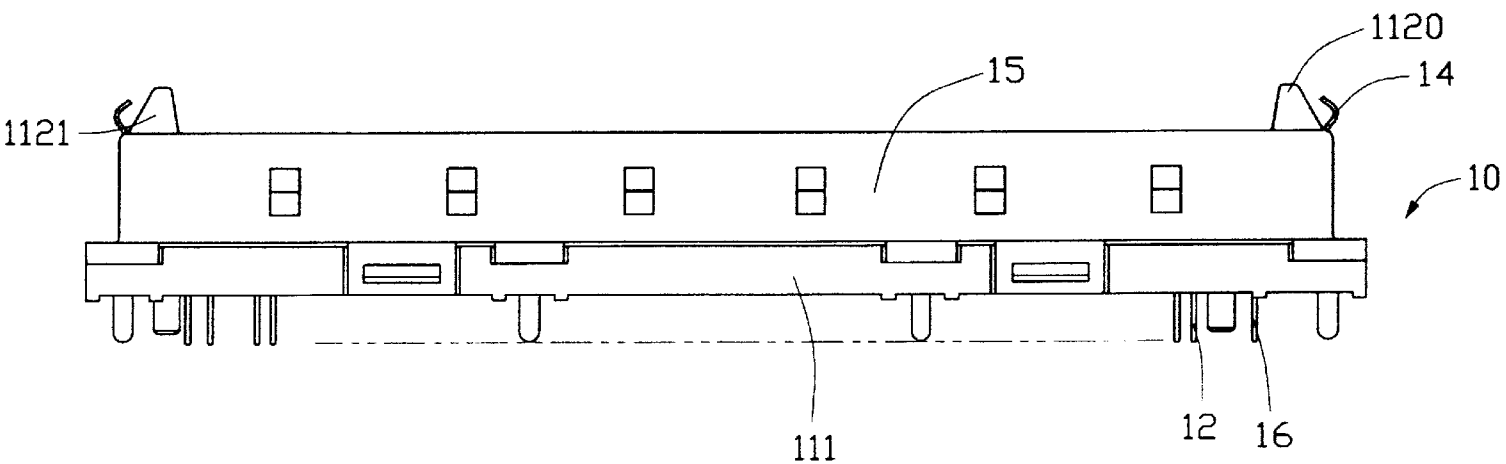
FIG. 3 is a front elevational view of the electrical connector of FIG. 2.
Figure 4:
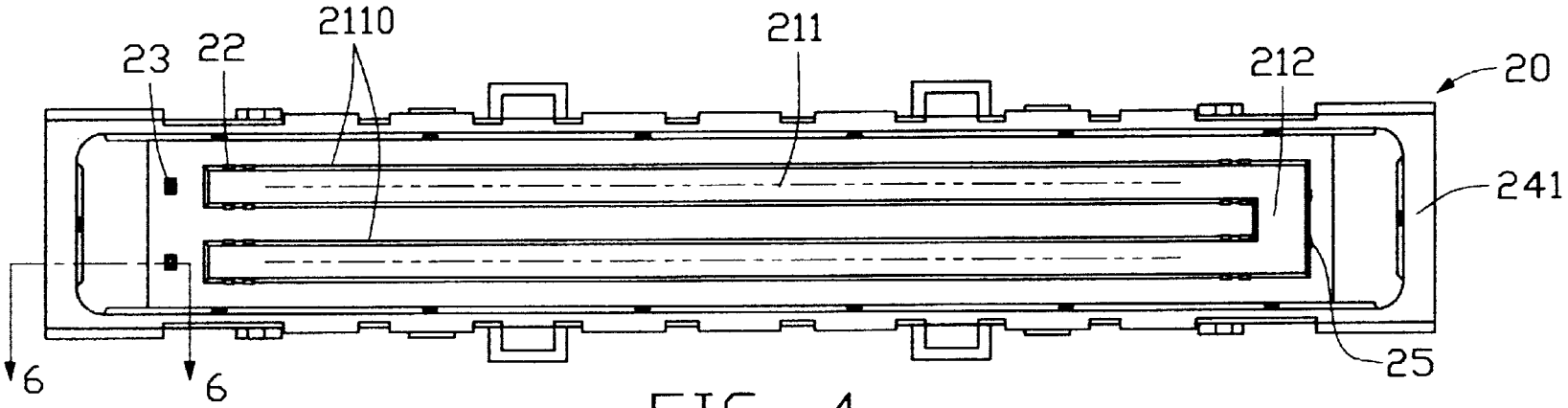
FIG. 4 is a top plan view of the mating connector of FIG. 1.
Figure 5:
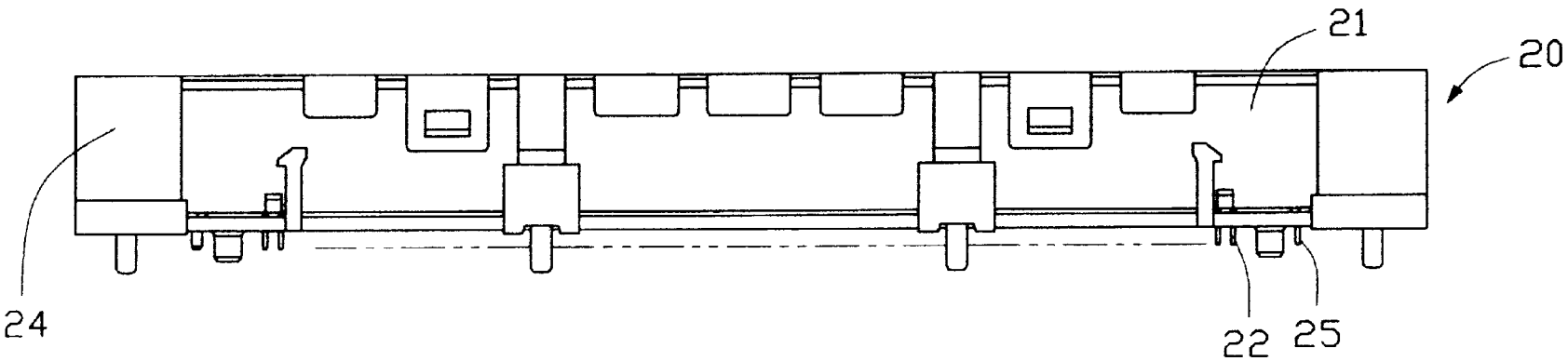
FIG. 5 is a front elevtional view of the mating connector of FIG. 4.
Figure 6:
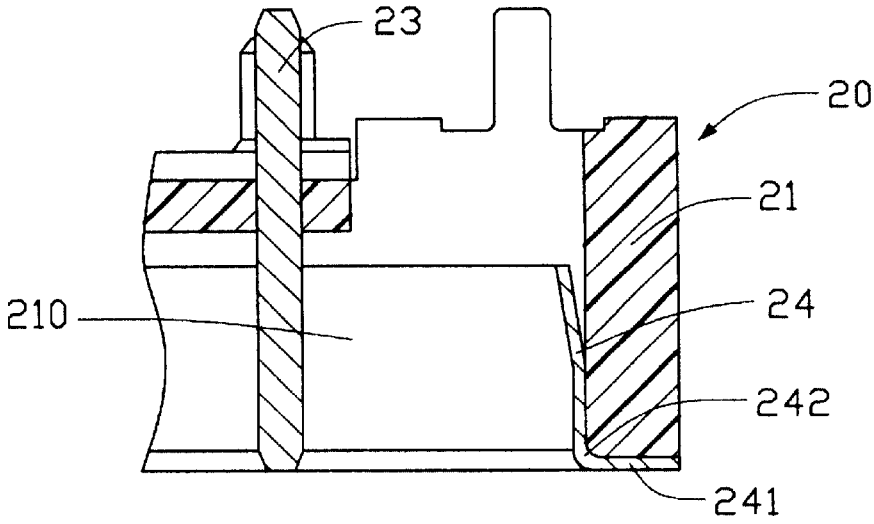
FIG. 6 is a cross-sectional view of the mating connector taken along line 6—6 of FIG. 4.

Referring to FIGS. 1, 2 and 3, an electrical connector 10 in accordance with the present invention is adapted to mate with a mating connector 20 complementary to the electrical connector 10 and together with the mating connector 20 configures an electrical assembly 1.

The electrical connector 10 comprises an insulative housing 11, a plurality of terminals 12 received in the insulative housing 11, a pair of metallic power clips 13 located at one end of the housing 11, a pair of L-shaped grounding bridges 14, and a metallic shield 15 attached to an outer side of the housing 11.

The insulative housing 11 includes an elongated base wall 111 and a mating wall 112 projecting upwardly from an upper surface of the base wall 111. The mating wall 112 defines, between a distal guiding column 1120 and a proximate guiding column 1121 opposing the distal guiding column 1120, a longitudinal first receiving cavity 1122 and a pair of second receiving cavity 1123 separated from the first receiving cavity 1122 by a baffle wall 1124. Two rows of terminal passageways are defined in opposite inner side walls 1125 of the mating wall 112. Moreover, two auxiliary terminal passageways are defined in an inner side 1126 of the distal guiding column 1120. A tongue 1127 extends from the baffle wall 1124 toward the distal guiding column 1120 and defines two rows of terminal passageways in opposite outer sides thereof. The tongue 1127 is parallel to the side walls 1125.

Figure 7:
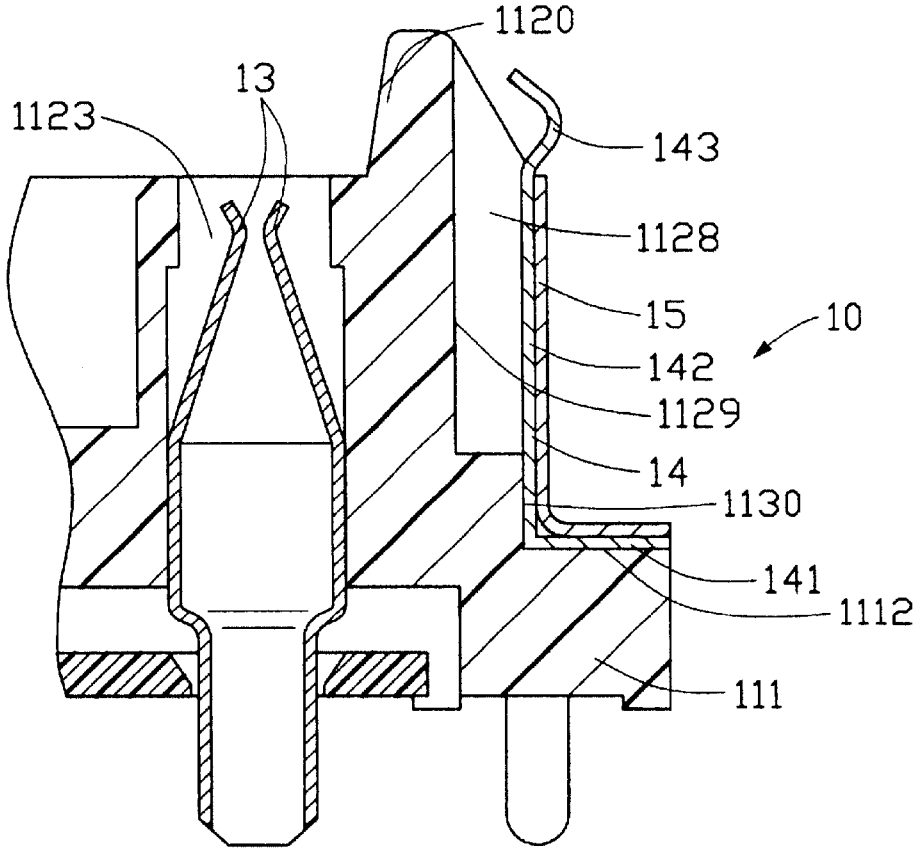
FIG. 7 is a cross-sectional view of the electrical connector taken along line 7—7 of FIG. 2.

Further referring to FIG. 7, each guiding column 1120, 1121 defines a slot 1128 (only one is shown) extending downwardly from a top end thereof to the upper surface of the base wall 111. Lower portions 1130 of inner walls of the slots 1128 are outwardly offset from upper portions 1129 of the slots 1128. A pair of notches 1112 (only one is shown) are defined in the upper surface of opposite ends of the base wall 111. Each notch 1112 communicates with a lower portion of a corresponding slot and extends outwardly throughout the base wall 111. The slots 1128 open to air from outer sides of the guiding columns 1120, 1121 and the notches 1112 open to air from the upper surface of the base wall 111.

Each L-shaped grounding bridge 14 has a horizontal body portion 141 and a resilient arm 142 extending upwardly an end of the body portion 141. A plurality of barbs (not shown) are formed on opposite sides of the body portion 141. The resilient arm 142 has a transversely curved contacting portion 143 on a free end thereof.

In assembly, the terminals 12 are received in the terminal passageways in the opposite side walls 1125 of the mating wall 112 and the outer sides of the tongue 1127. Two auxiliary terminals 16 are received in the terminal passageways in the inner side 1126 of the distal guiding column 1120. Each power clip 13 is received in a second receiving cavity 1123. The grounding bridges 14 are transversely inserted into the notches 1112 and the slots 1128 from ends of the base wall 111. The body portions 141 are received in the notches 1112 with the barbs engaging with the base wall 111. The resilient arms 142 extend in the slots 1128. The lower portions of the resilient arms 142 abut against the lower portions 1130 of the inner walls of the slots 1128. The metallic shield 15 is attached to an outer side of the housing 11 with the contacting portions 143 of the grounding bridges 14 upwardly and outwardly protruding beyond the shield 15. The grounding bridges 14 electrically connect with the shield 15 from the outer sides of the guiding columns 1120, 1121 and the upper surface of the base wall 111. Since the lower portions 1130 of the inner walls of the slots 1128 are outwardly offset from the upper portions 1129 of the slots 1128, the upper portions of the resilient arms 142 of the grounding bridges 14 are able to resiliently move in upper portions of the slots 1128 during the course of the engagement between the electrical connector 10 and the mating connector 20.

As is shown in FIGS. 1, 4, 5 and 6, the mating connector 20 comprises a dielectric mating housing 21, a plurality of mating terminals 22, a pair of power contacts 23, a metallic mating shield 24 attached to the mating housing 21 and two auxiliary mating terminals 25.

The mating housing 21 is elongated and defines an upward facing recess 210. Two parallelly arranged mating tongues 211 are located in the recess 210 with their distal ends being perpendicularly interconnected by a bridge wall 212. The mating tongues 211 and the bridge wall 212 are adapted to be received in the first receiving cavity 1122. Each mating tongue 211 defines engaging surfaces 2110 on opposite sides thereof and the bridge wall 212 defines a contacting surface 2120 merely on a side facing the distal guiding column 1120. The mating terminals 22 are positioned on the engaging surface 2110 of the mating tongues 211 whereas two auxiliary mating terminals 25 are positioned on the contacting surface 2120. The power contacts 23 are located an end of the recess 210 far away from the bridge wall 212.

The mating shield 24 has a peripheral wall 240 wrapping an inner side of the recess 210 and two flanges 241 covering opposite ends of an upper surface of the mating housing 21. The flanges 241 perpendicularly join to the peripheral wall 240 at joints 242.

Figure 8:
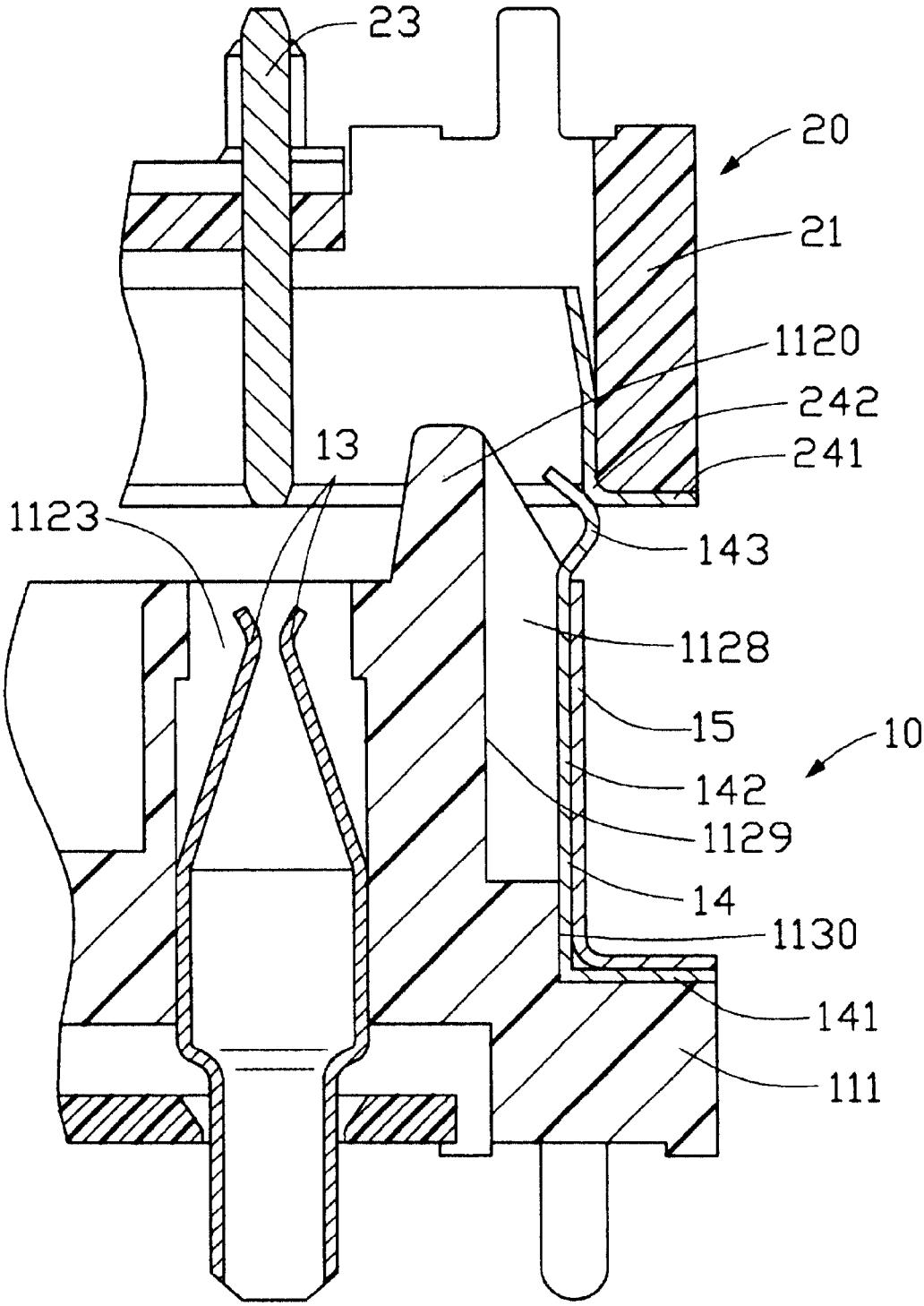
FIG. 8 is a view similar to FIG. 7 with the mating connector of FIG. 6 shown.
Figure 9:
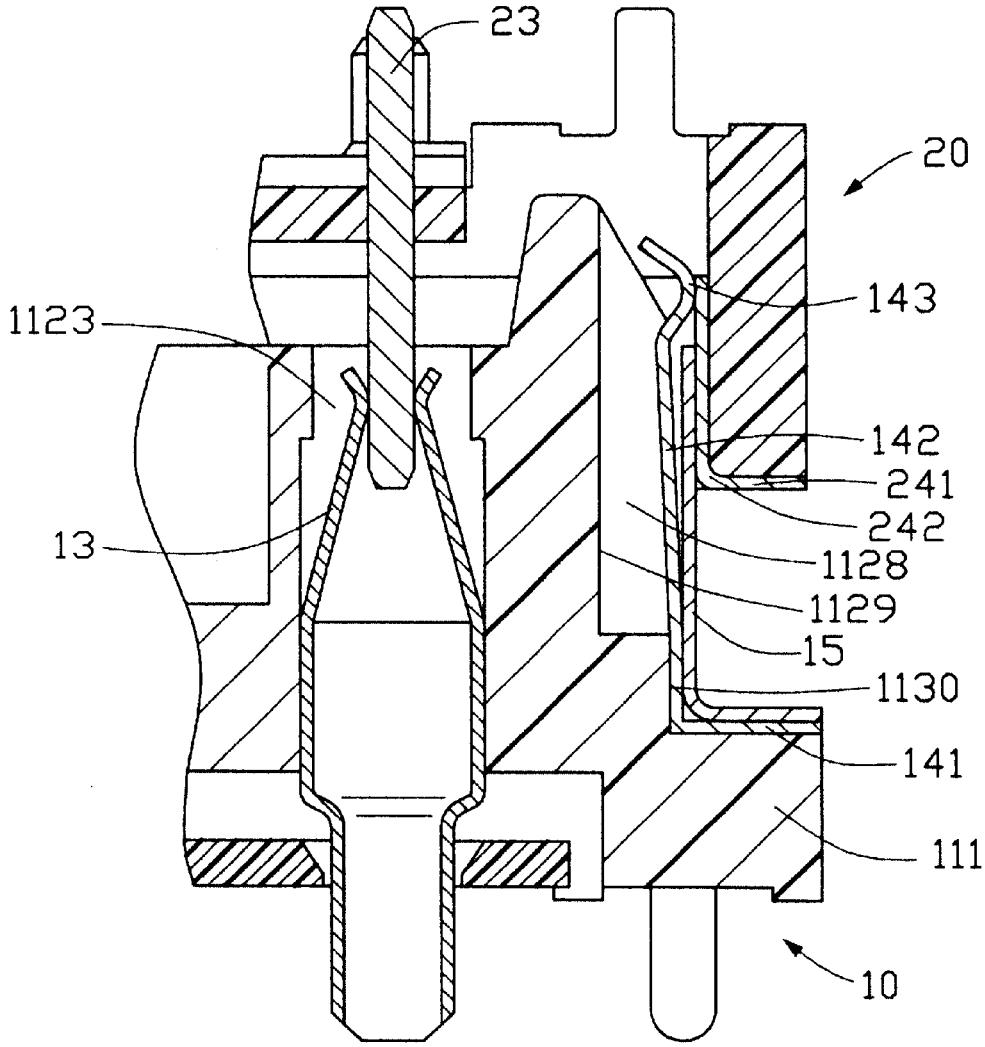
FIG. 9 is a view similar to FIG. 8, showing the electrical connector and the mating connector haven been engaged with each other.

When the electrical connector 10 and the mating connector 20 are engaged, as is shown in FIGS. 8 and 9, the joints 242 of the mating shield 24 contact the contacting portions 143 of the grounding bridges 14 of the electrical connector 10 before the terminals 22, 25 and the power contacts 23 of the mating connector 20 engage with corresponding terminals 12, 16 and power clips 13 of the electrical connector 10. Therefore, the static electronics deposited on the connectors 10, 20 are discharged prior to data transmitting and power current flowing between the electrical connector 10 and mating connector 20. Since the body portions 141 of the grounding bridges 14 are received and secured in the notches 1112 in the base wall 111, a reliable electrical connection between the grounding bridges 14 and the mating shield 24 is got. The two mating tongues 211 sandwiches the tongue 1127 so that the terminals 12 engage with the corresponding mating terminals 22 for data transmitting. Meanwhile, the contacting surface 2120 of the bridge wall 212 engages with the inner side 1126 of the distal guiding column 1120 such that the auxiliary terminals 16 engage with corresponding auxiliary mating terminals 25 for data transmitting. The power contacts 23 of the mating connector 20 are clipped by the power clips 13 of the electrical connector 10 for power current flowing therethrough.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector having a shield, comprising:

an insulative housing comprising an elongated base wall, a mating wall projecting upwardly from one surface of the base wall, a receiving cavity extending in the mating wall, a guiding column provided on the mating wall, a slot in the guiding column and a notch in the said surface of the base wall and communicating with the slot;

a plurality of terminals being positioned in the mating wall and exposed to the receiving cavity;

a metallic shield attached to the insulative housing;

a grounding bridge having a body portion secured in the notch and a resilient arm extending upwardly from the body portion in the slot in the guiding column, the grounding bridge electrically connecting with the metallic shield;

wherein a lower portion of an inner wall of the slot is outwardly offset from an upper portion of the inner wall of the slot;

wherein a lower portion of the resilient arm of the grounding bridge abuts against the lower portion of the inner wall of the slot and an upper portion of the resilient arm of the grounding bridge is resiliently moveable in an upper portion of the slot;

wherein the grounding bridge has a plurality of barbs on opposite sides of the body portion to engage with the base wall;

wherein the body portion of the grounding bridge electrically connects with the metallic shield from the surface of the base wall; and wherein the grounding bridge has a contacting portion upwardly and outwardly protruding beyond the metallic shield for contacting with the shield of the complementary connector.

2. An electrical connector assembly comprising:

first and second connectors, the first connector including:

a first insulative base including a base face with a mating face upwardly extending therefrom;

a guiding column located on one end of said mating face;

a plurality of first terminals disposed in the first housing;

a first metallic shell enclosing the base face vertically and the mating face horizontally; and a grounding bridge located around the guiding column and engaged with the first shell, said grounding bridge including a vertical section inwardly deflectably hidden behind the first shell with a contacting portion exposed above and outside the first shell when said grounding bridge is in a relaxed manner, said second connector including:

a second insulative housing;

a plurality of second terminals disposed in the second housing;

a second metallic shell enclosing said second housing; wherein said contacting portion is engaged with the second shell prior to said first shell, when said first connector and said second connector are mated with each other, wherein said grounding bridge is of an L-shape, further including a horizontal section sandwiched between the base face and the first shell;

wherein said horizontal section is perpendicular to said vertical section;

wherein said grounding bridge is hidden within the guiding column when said first connector and said second connector are mated with each other.

* * * * *